US010649367B2

(12) United States Patent
Matsumoto et al.

(10) Patent No.: US 10,649,367 B2
(45) Date of Patent: May 12, 2020

(54) POWDER SUPPLY DEVICE AND IMAGE FORMING APPARATUS INCORPORATING SAME

(71) Applicants: Junichi Matsumoto, Kanagawa (JP); Tatsuya Kubo, Kanagawa (JP); Shuntaroh Tamaki, Kanagawa (JP); Hiroaki Okamoto, Kanagawa (JP)

(72) Inventors: Junichi Matsumoto, Kanagawa (JP); Tatsuya Kubo, Kanagawa (JP); Shuntaroh Tamaki, Kanagawa (JP); Hiroaki Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/523,025

(22) Filed: Jul. 26, 2019

(65) Prior Publication Data

US 2020/0033751 A1 Jan. 30, 2020

(30) Foreign Application Priority Data

Jul. 30, 2018 (JP) ..... 2018-142774
Jun. 28, 2019 (JP) ..... 2019-121099

(51) Int. Cl.
*G03G 15/08* (2006.01)

(52) U.S. Cl.
CPC ..... *G03G 15/086* (2013.01)

(58) Field of Classification Search
CPC ..... G03G 15/086
See application file for complete search history.

(56) References Cited

U.S. PATENT DOCUMENTS 4,133,453 A * 1/1979 Ohbora ..... G01F 23/263 222/39
5,987,269 A * 11/1999 Allen ..... G03G 15/086 399/27
6,208,816 B1 * 3/2001 Koizumi ..... G03G 21/1867 399/27
6,415,112 B1 * 7/2002 Kimizuka ..... G03G 21/1814 399/27
2002/0021908 A1 * 2/2002 Matsumoto ..... G03G 21/1814 399/27
2002/0025174 A1 * 2/2002 Sakurai ..... G03G 21/1814 399/13
2002/0172521 A1 * 11/2002 Oguma ..... G03G 21/1867 399/27
2003/0016955 A1 * 1/2003 Hiratsuka ..... G03G 15/0803 399/27

(Continued)

FOREIGN PATENT DOCUMENTS

JP 2004-286792 10/2004
JP 2018-197808 12/2018

*Primary Examiner* — David J Bolduc
(74) *Attorney, Agent, or Firm* — Oblon, McClelland, Maier & Neustadt, L.L.P.

(57) ABSTRACT

A powder supply device includes a powder conveyance path and a pair of electrodes to supply powder from a powder container. The powder conveyance path is configured to transport the powder in the powder container. The pair of electrodes is disposed at least in part in or on the powder conveyance path. The powder supply device is configured to detect an amount of powder in the powder conveyance path based on change of capacitance between the pair of electrodes.

18 Claims, 14 Drawing Sheets

(56) References Cited

U.S. PATENT DOCUMENTS

| | | | | |
|---|---|---|---|---|
| 2003/0123888 | A1* | 7/2003 | Naito | G03G 15/0856 399/27 |
| 2003/0180061 | A1* | 9/2003 | Oguma | G03G 21/1867 399/27 |
| 2007/0104518 | A1* | 5/2007 | Ohyama | G03G 15/0812 399/284 |
| 2007/0206965 | A1* | 9/2007 | Namiki | G03G 15/0856 399/27 |
| 2008/0069576 | A1* | 3/2008 | Etter | G03G 21/12 399/35 |
| 2008/0260432 | A1* | 10/2008 | Ohyama | G03G 15/0856 399/258 |
| 2014/0363179 | A1* | 12/2014 | Kusukawa | G03G 15/0889 399/27 |
| 2015/0016829 | A1* | 1/2015 | Watanabe | G03G 15/0856 399/27 |
| 2015/0086227 | A1* | 3/2015 | Shindo | G03G 15/086 399/27 |
| 2015/0301474 | A1* | 10/2015 | Barry | G03G 15/0856 399/284 |
| 2016/0084924 | A1* | 3/2016 | Osumi | G01R 33/1223 324/236 |
| 2016/0097993 | A1* | 4/2016 | Shinohara | G03G 15/086 399/27 |
| 2017/0227922 | A1 | 8/2017 | Takami et al. | |
| 2017/0363987 | A1 | 12/2017 | Nodera et al. | |
| 2018/0120737 | A1 | 5/2018 | Okamoto et al. | |
| 2018/0329358 | A1 | 11/2018 | Takami et al. | |
| 2018/0341199 | A1 | 11/2018 | Yamashita et al. | |
| 2018/0348698 | A1 | 12/2018 | Tamaki et al. | |
| 2019/0064699 | A1 | 2/2019 | Nodera et al. | |

* cited by examiner

POWDER SUPPLY DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2018-142774, filed on Jul. 30, 2018 and 2019-121099, filed on Jun. 28, 2019, in the Japan Patent Office, the entire disclosure of each of which is hereby incorporated by reference herein.

BACKGROUND

Technical Field

Embodiments of the present disclosure generally relate to a powder supply device and an image forming apparatus incorporating the powder supply device.

Description of the Related Art

There are known powder supply devices that include a powder conveyance path configured to transport powder from a powder container.

SUMMARY

Embodiments of the present disclosure describe an improved powder supply device that includes a powder conveyance path and a pair of electrodes to supply powder from a powder container. The powder conveyance path is configured to transport the powder in the powder container. The pair of electrodes is disposed at least in part in or on the powder conveyance path. The powder supply device is configured to detect an amount of powder in the powder conveyance path based on change of capacitance between the pair of electrodes.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
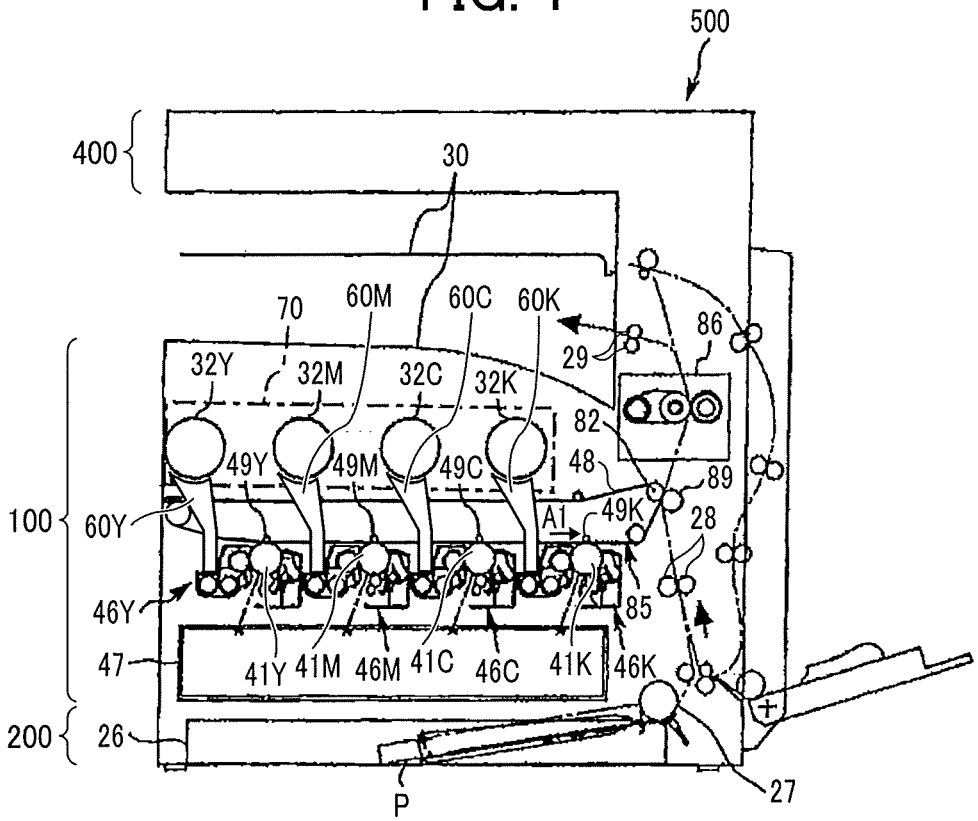
FIG. 1 is a schematic view of a copier as an example of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Descriptions are given below of a copier 500 as an example of an image forming apparatus according to embodiments of the present disclosure.

FIG. 1 is a schematic view of the copier 500 according to the present embodiment. The copier 500 includes a copier body (hereinafter referred to as "a printer unit 100"), a sheet feeding table (hereinafter referred to as "a sheet feeder 200"), and a scanner disposed above the printer unit 100 (hereinafter referred to as "a scanner unit 400").

A toner container mount 70 is disposed in an upper portion of the printer unit 100. Four replaceable toner containers 32Y, 32M, 32C, and 32K as powder containers (also collectively referred to as "toner containers 32") to contain yellow, magenta, cyan, and black toners, respectively, are installed in the toner container mount 70. Below the toner container mount 70, an intermediate transfer unit 85 is disposed.

The intermediate transfer unit 85 includes an intermediate transfer belt 48, four primary transfer rollers 49Y, 49M, 49C, and 49K, a secondary transfer backup roller 82, multiple tension rollers, and a belt cleaning device. The intermediate transfer belt 48 is stretched and supported by the above-described multiple rollers and is rotated in the direction indicated by arrow A1 in FIG. 1 as the secondary transfer backup roller 82 of the multiple rollers rotates.

In the printer unit 100, four image forming units 46Y, 46M, 46C, and 46K (also collectively referred to as "image forming units 46") are arranged in parallel, facing an intermediate transfer belt 48 to form yellow, magenta, cyan, and black (Y, M, C, and K) toner images, respectively. Four toner supply devices 60Y, 60M, 60C, and 60K (also collectively referred to as "toner supply devices 60") are disposed below the corresponding four toner containers 32Y, 32M, 32C, and 32K, respectively. The toner supply devices 60Y, 60M, 60C, and 60K supply toners contained in the corresponding toner containers 32Y, 32M, 32C, and 32K to developing devices 50 (see developing device 50Y in FIG. 2) of the corresponding image forming units 46Y, 46M, 46C, and 46K. The supplied toners serving as powder are used in the developing devices 50.

As illustrated in FIG. 1, the printer unit 100 further includes an exposure device 47 as a latent image forming device below the four image forming units 46. The exposure device 47 exposes surfaces of photoconductors 41Y, 41M, 41C, and 41K to be described later based on image data and forms electrostatic latent images on the surfaces of the photoconductors 41Y, 41M, 41C, and 41K. The image data is acquired by the scanner unit 400 that read an original document or input from an external device such as a personal computer. The exposure device 47 of the printer unit 100 employs a laser beam scanner method using a laser diode in the present embodiment, but other configurations using, for example, a light emitting diode (LED) array can be used as the exposure device 47.

Figure 2:
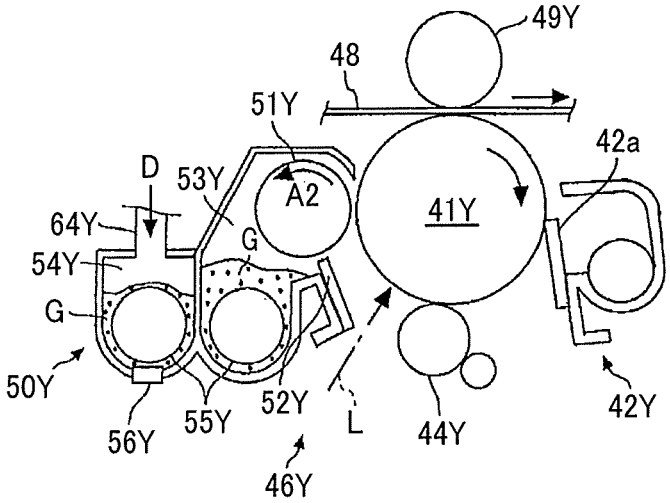
FIG. 2 is a schematic view of an image forming unit for yellow included in the copier in FIG. 1.

FIG. 2 is a schematic view of the image forming unit 46Y for yellow.

The image forming unit 46Y includes the drum-shaped photoconductor 41Y serving as a latent image bearer. The image forming unit 46Y further includes a charging roller 44Y as a charging device, a developing device 50Y, a cleaning device 42Y to clean the photoconductor 41Y, and a discharger around the photoconductor 41Y. Image forming processes, namely, charging, exposure, development, transfer, and cleaning processes, are performed on the photoconductor 41Y, and thus a yellow toner image is formed on the photoconductor 41Y.

The three other image forming units 46M, 46C, and 46K have a similar configuration to that of the yellow image forming unit 46Y except for the color of the toner used therein and form magenta, cyan, and black toner images on the photoconductors 41M, 41C, and 41K, respectively. Thus, only the image forming unit 46Y is described below and descriptions of the three other image forming units 46M, 46C, and 46K are omitted.

The photoconductor 41Y is rotated clockwise in FIG. 2, driven by a drive motor. A surface of the photoconductor 41Y is charged uniformly at a position opposite the charging roller 44Y (a charging process). When the surface of the photoconductor 41Y reaches a position to receive a laser beam L emitted from the exposure device 47, the photoconductor 41Y is scanned with the laser beam L, and thus an electrostatic latent image for yellow is formed thereon (an exposure process). Then, the surface of the photoconductor 41Y reaches a position opposite the developing device 50Y, where the electrostatic latent image is developed with toner into a yellow toner image (a development process).

The four primary transfer rollers 49Y, 49M, 49C, and 49K of the intermediate transfer unit 85 are pressed against the corresponding photoconductors 41Y, 41M, 41C, and 41K via the intermediate transfer belt 48, thereby forming primary transfer nips. The primary transfer rollers 49Y, 49M, 49C, and 49K receive transfer biases opposite in polarity to that of the toner.

When the surface of the photoconductor 41Y, on which the toner image is formed in the development process, reaches a position opposite the primary transfer roller 49Y via the intermediate transfer belt 48 (i.e., the primary transfer nip), the toner image on the photoconductor 41Y is transferred onto the intermediate transfer belt 48 at the primary transfer nip (a primary transfer process). After the primary transfer process, a certain amount of untransferred toner remains on the photoconductor 41Y. After the toner image on the photoconductor 41Y is transferred onto the intermediate transfer belt 48 at the primary transfer nip, the surface of the photoconductor 41Y reaches a position opposite the cleaning device 42Y. At this position, the untransferred toner remaining on the surface of the photoconductor 41Y is mechanically collected by a cleaning blade 42*a* (a cleaning process). Subsequently, the surface of the photoconductor 41Y reaches a position opposite the discharger, and the discharger eliminates a residual potential from the surface of the photoconductor 41Y. Thus, a sequence of image forming processes performed on the photoconductor 41Y is completed.

The above-described image forming processes are performed also in the other image forming units 46M, 46C, and 46K similarly to the yellow image forming unit 46Y. That is, the exposure device 47 disposed below the image forming units 46M, 46C, and 46K irradiates the photoconductors 41M, 41C, and 41K of the image forming units 46M, 46C, and 46K with the laser beam L based on image data, respectively. Specifically, the exposure device 47 includes light sources to emit the laser beams L, multiple optical elements, and a polygon mirror that is rotated by a motor. The laser beams L are directed to the respective photoconductors 41M, 41C, and 41K via the multiple optical elements while being deflected by the polygon mirror. Then, the toner images are formed on the photoconductors 41M, 41C, and 41K through the development process and transferred onto the intermediate transfer belt 48.

At that time, the intermediate transfer belt 48 rotates in the direction indicated by arrow A1 in FIG. 1 and passes through the primary transfer nips of the primary transfer rollers 49Y, 49M, 49C, and 49K. The respective single-color toner images on the photoconductors 41Y, 41M, 41C, and 41K are primarily transferred to the intermediate transfer belt 48 in layers, thereby forming a multicolor toner image on the intermediate transfer belt 48.

Then, the intermediate transfer belt 48, on which the respective single-color toner images are superimposed to form the multicolor image, reaches a position opposite the secondary transfer roller 89. The secondary transfer backup roller 82 and the secondary transfer roller 89 press against each other via the intermediate transfer belt 48, and the contact portion therebetween is hereinafter referred to as a secondary transfer nip. The multicolor toner image formed on the intermediate transfer belt 48 is transferred onto a recording medium P such as a transfer sheet conveyed to the secondary transfer nip. After the secondary transfer process, a certain amount of untransferred toner, which is not transferred to the recording medium P, remains on the intermediate transfer belt 48. After the secondary transfer nip, as the intermediate transfer belt 48 reaches a position opposite the belt cleaning device, the untransferred toner on a surface of the intermediate transfer belt 48 is collected by the belt cleaning device to complete a series of transfer processes on the intermediate transfer belt 48.

Next, conveyance of the recording medium P is described below.

The recording medium P is conveyed from a sheet feeding tray 26 of the sheet feeder 200 disposed below the printer unit 100 to the secondary transfer nip via a sheet feeding roller 27 and a registration roller pair 28. More specifically, the sheet feeding tray 26 contains multiple recording media P piled one on another. As the sheet feeding roller 27 rotates counterclockwise in FIG. 1, the topmost sheet of the recording media Pin the sheet feeding tray 26 is fed between the registration roller pair 28.

The registration roller pair 28 stops rotating temporarily, stopping the recording medium P with a leading edge of the recording medium P nipped in the registration roller pair 28. Then, the registration roller pair 28 rotates to convey the recording medium P to the secondary transfer nip, timed to coincide with the arrival of the multicolor toner image on the intermediate transfer belt 48 at the secondary transfer nip. Thus, the multicolor toner image is transferred onto the recording medium P.

The recording medium P onto which the multicolor toner image is transferred at the secondary transfer nip is conveyed to a fixing device 86. In the fixing device 86, a fixing belt and a pressure roller apply heat and pressure to the recording medium P to fix the multicolor toner image on the recording medium P. After passing through the fixing device 86, the recording medium P is ejected by an output roller pair 29 outside the printer unit 100. The recording media P ejected by the output roller pair 29 are sequentially stacked on a stack tray to complete a sequence of image forming processes performed by the copier 500.

Next, a configuration and operation of the developing device 50 of the image forming unit 46 are described in further detail below. Although the image forming unit 46Y for yellow is described as an example below, the other image forming units 46M, 46C, and 46K have a similar configuration and operate similarly to the image forming unit 46Y for yellow.

As illustrated in FIG. 2, the developing device 50Y includes a developing roller 51Y, a doctor blade 52Y, two developer conveying screws 55Y, and a toner concentration sensor 56Y. The developing roller 51Y is opposed to the photoconductor 41Y, and the doctor blade 52Y is opposed to the developing roller 51Y. The two developer conveying screws 55Y are disposed in first and second developer containing compartments 53Y and 54Y. The developing roller 51Y includes a stationary magnet roller and a sleeve that rotates around the magnet roller. The first and second developer containing compartments 53Y and 54Y contain two-component developer G including carrier and toner. The second developer containing compartment 54Y communicates, via an opening on an upper side thereof, with a downward toner passage 64Y. The toner concentration sensor 56Y detects a concentration of toner in the developer G in the second developer containing compartment 54Y.

In the developing device 50Y, the developer conveying screws 55Y stir and circulate the developer G between the first and second developer containing compartments 53Y and 54Y. While being transported by the developer conveying screw 55Y, the developer Gin the first developer containing compartment 53 Y is attracted by magnetic fields generated by the magnet roller inside the developing roller 51Y and carried onto a sleeve surface of the developing roller 51Y. The developer G carried on the developing roller 51Y moves along the circumference of the developing roller 51Y as the sleeve of the developing roller 51Y rotates counterclockwise in FIG. 2 as indicated by arrow A2. At that time, toner in the developer G is triboelectrically charged through friction with carrier to have a potential opposite in polarity to that of the carrier. Then, the toner is electrostatically attracted to the carrier and carried on the developing roller 51Y together with the carrier by the magnetic field generated on the developing roller 51Y.

The developer G carried on the developing roller 51Y is transported in the direction indicated by arrow A2 in FIG. 2 to a position where the doctor blade 52Y is opposed to the developing roller 51Y. Then, an amount of developer G on the developing roller 51Y is adjusted to a suitable amount by the doctor blade 52Y, after which the developer G is carried to a development range opposite the photoconductor 41Y. In the development range, the toner in developer G is attracted to the latent image formed on the photoconductor 41Y due to effect of a developing electric field generated between the developing roller 51Y and the photoconductor 41Y. As the sleeve rotates, the developer G remaining on the developing roller 51Y after passing the development range reaches an upper part in the first developer containing compartment 53Y and then drops from the developing roller 51Y.

The percentage or concentration of toner in developer G contained in the developing device 50Y is adjusted within a predetermined range. Specifically, the toner supply device 60Y, to be described later, supplies the toner from the toner container 32Y to the second developer containing compartment 54Y according to toner consumption for development in the developer G in the developing device 50Y.

The developer conveying screws 55Y stir the toner supplied to the second developer containing compartment 54Y, together with the developer G, and circulate the toner between the first and second developer containing compartments 53Y and 54Y.

Next, a configuration of the toner supply devices 60Y, 60M, 60C, and 60K is described below.

Figure 3:
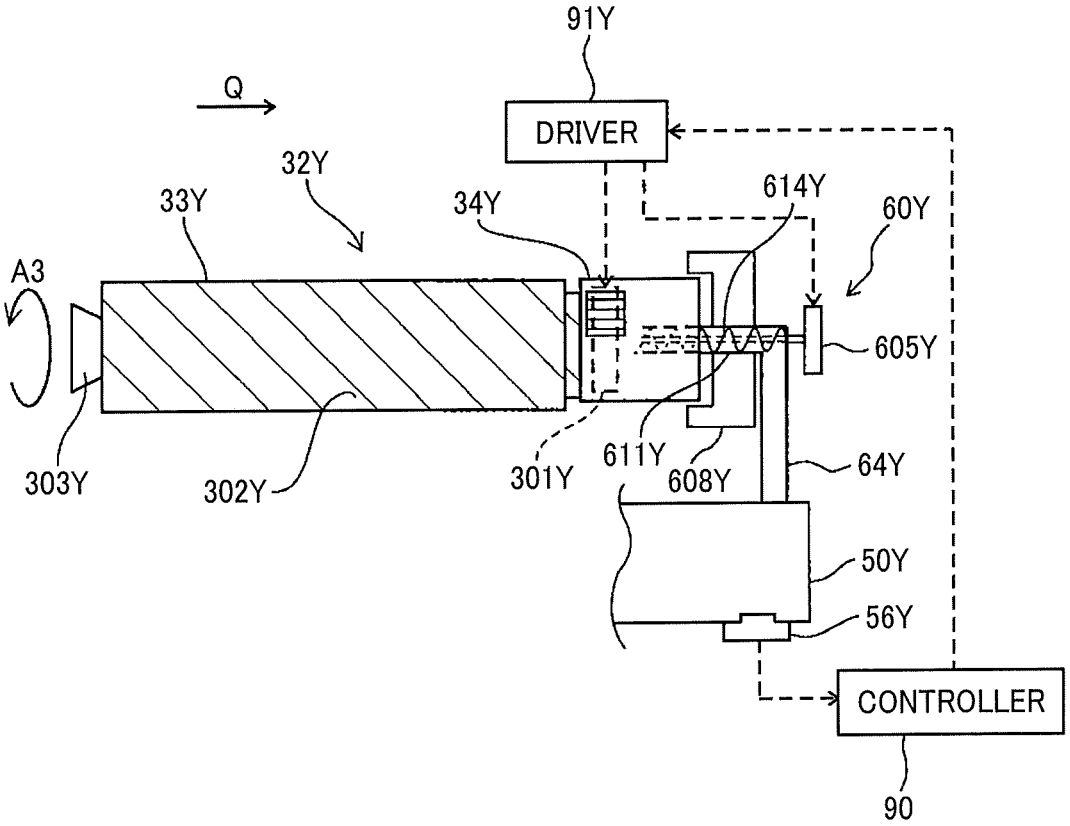
FIG. 3 is a schematic view of a toner supply device of the copier in FIG. 1, in which a toner container is installed.
Figure 4:
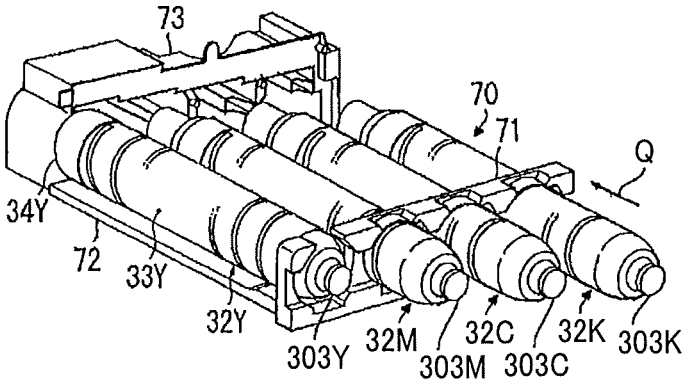
FIG. 4 is a perspective view of four toner containers mounted in a toner container mount of the copier in FIG. 1.

FIG. 3 is a schematic view illustrating the toner container 32Y is attached to the toner supply device 60Y. FIG. 4 is a perspective view of the four toner containers 32Y, 32M, 32C, and 32K mounted in the toner container mount 70.

The respective color toners contained in the toner containers 32Y, 32M, 32C, and 32K mounted in the toner container mount 70 of the printer unit 100 are supplied to the corresponding developing devices 50 of the image forming units 46Y, 46M, 46C, and 46K according to the amount of the toner consumption in the developing devices 50. The toner supply devices 60Y, 60M, 60C, and 60K supply the respective color toners from the toner containers 32Y, 32M, 32C, and 32K to the corresponding developing devices 50, respectively. The four toner supply devices 60Y, 60M, 60C, and 60K and the toner containers 32Y, 32M, 32C, and 32K have a similar configuration except the color of the toner used in the image forming processes. Therefore, the toner supply device 60Y and the toner container 32Y for yellow are described below as representatives, and descriptions of the toner supply devices 60M, 60C, and 60K and the toner containers 32M, 32C, and 32K for the three other colors are omitted.

The toner supply devices 60Y, 60M, 60C, and 60K include the toner container mount 70. The toner supply device 60Y includes a conveyance nozzle 611Y as a powder conveyance path, a conveying screw 614Y, the downward toner passage 64Y, and a driver 91Y to rotate the toner container 32Y.

In conjunction with insertion of the toner container 32Y as the powder container into the toner container mount 70 of the printer unit 100 in the direction indicated by arrow Q illustrated in FIGS. 3 and 4, the conveyance nozzle 611Y of the toner supply device 60Y is inserted into the toner container 32Y from the leading end side of the toner container 32Y. With this action, an interior of the toner container 32Y communicates with the conveyance nozzle 611Y.

The toner container 32Y is, for example, a substantially cylindrical bottle. The toner container 32Y includes a container end cover 34Y held by the toner container mount 70 not to rotate and a container body 33Y formed together with a container gear 301Y. The container body 33Y is held to rotate relative to the container end cover 34Y.

The toner container mount 70 mainly includes a container cover receiving section 73, a container receiving section 72, and an insertion hole part 71. The container cover receiving section 73 holds the container end cover 34Y of the toner container 32Y, and the container receiving section 72 holds the container body 33Y of the toner container 32Y. The insertion hole part 71, together with the container receiving section 72, defines an insertion opening into which the toner container 32Y is inserted. When a front cover of the copier 500 (on the front side in the direction perpendicular to the surface of the paper on which FIG. 1 is drawn) is opened, the insertion hole part 71 of the toner container mount 70 is exposed. The toner containers 32Y, 32M, 32C, and 32K are inserted and removed on the front side of the copier 500 with the long axis of the toner containers 32 kept horizontal in the longitudinal direction of the toner containers 32Y, 32M, 32C, and 32K. Note that a socket 608Y illustrated in FIG. 3 is a portion of the container cover receiving section 73 of the toner container mount 70.

Herein, the longitudinal length of the container receiving section 72 is almost equal to the longitudinal length of the container body 33Y. The container cover receiving section 73 is located on one side (on the leading end side of the toner container 32Y in the direction of insertion) in the longitudinal direction of the container receiving section 72. The insertion hole part 71 is located on the other side (on the upstream side in the direction of insertion) of the container receiving section 72. Accordingly, in the insertion of the toner container 32Y into the toner container mount 70, the container end cover 34Y passes through the insertion hole part 71, slides on the container receiving section 72 for a certain distance, and is then attached to the container cover receiving section 73.

In a state in which the container end cover 34Y is attached to the container cover receiving section 73, rotation driving force is input to the container gear 301Y of the container body 33Y from the driver 91Y including a drive motor and a drive gear. With this driving force, the container body 33Y is rotated in the direction indicated by arrow A3 illustrated in FIG. 3 (hereinafter "rotation direction A3"). The container body 33Y includes a helical rib 302Y protruding inward from an inner face of the container body 33Y. As the container body 33Y rotates, the helical rib 302Y transports toner in the container body 33Y from the container rear end to the container front end (from the left to the right in FIG. 3) in the longitudinal direction of the container body 33Y.

On the side of the container end cover 34Y of the container body 33 (the right side in FIG. 3), a scooping portion is provided to lift (scoop) the toner being transported to the container front side by the helical rib 302 as the container body 33 rotates in the rotation direction A3. The scooping portion scoops up the toner above the conveyance nozzle 611Y inserted into the toner container 32Y. Then, the toner falls to a nozzle hole 610 (see FIG. 5) and is supplied into the conveyance nozzle 611Y. The nozzle hole 610 is disposed on the toner container side end of the conveyance nozzle 611Y.

The conveying screw 614Y is disposed inside the conveyance nozzle 611Y. When the driver 91Y inputs driving force to a conveying screw gear 605Y, the conveying screw 614Y rotates, thus transporting toner inside the conveyance nozzle 611Y horizontally. A downstream end of the conveyance nozzle 611Y in a direction of conveyance of toner (hereinafter referred to as "toner conveyance direction") is coupled to the downward toner passage 64Y. The toner transported by the conveying screw 614Y drops under the gravity through the downward toner passage 64Y and is supplied to the developing device 50Y, in particular, to the second developer containing compartment 54Y.

The toner containers 32Y, 32M, 32C, and 32K are replaced with new ones when the respective service lives thereof have expired, that is, when almost all toner contained in the toner containers 32 have been depleted. A handle 303Y is disposed at the end of the toner container 32Y opposite the container end cover 34Y. Users can grasp the handle 303Y, 303M, 303C, and 303K to remove the toner container 32Y, 32M, 32C, and 32K from the copier 500 in replacement, respectively.

Based on the image data used by the above-described exposure device 47, a controller 90 can calculate the toner consumption and determine that toner supply to the developing device 50Y is necessary. Alternatively, based on a detection result obtained by the toner concentration sensor 56Y, the controller 90 can detect that the percentage of toner in the developing device 50Y has decreased. Then, the controller 90 drives the driver 91Y to rotate the container body 33Y of the toner container 32Y and the conveying screw 614Y for a predetermined time period, thereby supplying the toner to the developing device SOY. Since the conveying screw 614Y inside the conveyance nozzle 611Y rotates to supply toner, the amount of toner supplied from the toner container 32Y can be calculated accurately by detecting the number of rotations of the conveying screw 614Y.

In the toner supply device 60Y, the amount of toner supplied to the developing device SOY is controlled with the number of rotations of the conveying screw 614Y. Accordingly, on the downstream side of the conveyance nozzle 611Y in the direction to supply toner, the amount of toner to be supplied to the developing device 50Y is not restricted, and the toner is conveyed through the downward toner passage 64 directly to the developing device SOY. Alternatively, in the toner supply device 60Y in which the conveyance nozzle 611Y is inserted into the toner container 32Y as in the present embodiment, a toner reservoir such as a toner hopper can be provided between the toner container 32Y and the developing device 50Y. Then, the amount of toner conveyed from the toner reservoir to the developing device 50Y can be adjusted to control the amount of toner supplied to the developing device SOY. However, the configuration without the toner reservoir, such as the toner supply device 60Y according to the present embodiment, is advantageous in that the toner supply device 60Y can be compact, thereby reducing the size of the entire copier 500.

Although the conveying screw 614Y transports the toner in the conveyance nozzle 611Y in the toner supply device 60Y according to the present embodiment, the structure to transport the toner in the conveyance nozzle 611Y is not limited to screws. For example, a powder pump can be used to generate a negative pressure at the nozzle opening of the conveyance nozzle 611Y to generate force to transport the toner.

Next, the detection of toner remaining in the toner container in the present embodiments is described.

There are a number of methods used to detect that toner in the toner container is depleted (i.e., toner depletion). Thus, a method of detecting the toner depletion is based on the number of operations or duration to discharge toner from the toner container, or an amount of toner that moves from the developing device to the photoconductor (i.e. a first method). However, the toner depletion detection accuracy is poor because an amount of toner to be supplied or consumed varies due to errors such as variations of environmental conditions.

Another method of detecting the toner depletion is based on a detection result obtained by a piezoelectric sensor that detects a toner height in a sub-hopper, which is provided to temporarily store toner discharged from the toner container (i.e., a second method).

The second method requires the sub-hopper, causing an increase in the cost and size of the toner supply devices. Further, in the second method using the piezoelectric sensor to detect the toner depletion, pressure applied to a vibrating sensing portion of the piezoelectric sensor changes depending on whether or not the toner is contact with the sensing portion. Accordingly, the vibration condition changes, enabling the presence or absence of toner in the sub-hopper to be detected. When toner in the toner container 32Y is depleted, toner is not supplied to the sub-hopper. As a result, the toner height in the sub-hopper decreases, enabling the piezoelectric sensor to detect the absence of toner. Thus, the toner depletion (i.e., toner in the toner container 32Y is depleted) can be detected. However, in the second method, if toner adheres to the sensing portion, the vibration condition changes, thereby preventing the piezoelectric sensor from detecting the toner depletion with high accuracy. Therefore, the sensing portion needs to be cleaned regularly. In addition, depending on flowability of toner, the pressure applied to the sensing portion is different, and the vibration condition changes, thereby preventing the piezoelectric sensor from detecting the toner depletion with high accuracy.

In a comparative example, a pair of electrodes is disposed below the toner container and arranged in parallel with a predetermined space from the toner container. Capacitance in the toner container is measured by the pair of electrodes, thereby detecting the amount of toner remaining in the toner container (i.e., a third method). However, when the toner container is empty, the toner container is replaced with a full toner container. Therefore, a distance between the pair of electrodes and the toner container varies due to a shape error of the toner container, and a relation between the capacitance and the amount of toner is different for each toner container to be replaced, thereby preventing the pair of electrodes from detecting the toner depletion with high accuracy.

With such a configuration in which the toner container rotates as described in the present embodiment, the toner container may be eccentric while rotating. With this eccentricity, the distance between the pair of electrodes and the toner container varies, and the relation between the capacitance and the amount of toner changes, thereby preventing the pair of electrodes from detecting the toner depletion with high accuracy.

Further, since toner is powder and thus unlike a liquid, the toner may be unevenly distributed in the toner container in the horizontal direction. Accordingly, with the configuration in which the pair of electrodes detects the capacitance in a part of the toner container, for example, when the amount of toner at a portion where the capacitance is detected is less than that of the other portions, the toner in the toner container may be detected as being scarce although the toner is sufficient in the toner container.

In another comparative example of the third method, a pair of electrodes detects capacitance of entire toner container. However, the toner container is large enough not to be replaced frequently. Therefore, in the case in which the pair of electrodes detects the capacitance of entire toner container, the pair of electrodes increases in size, causing cost up. In addition, since the distance between the pair of electrodes becomes long, the capacitance may not be detected with high sensitivity.

Therefore, in the present embodiment, a powder supply device includes a pair of electrodes disposed on the conveyance nozzle 611Y serving as the powder conveyance path, and an amount of toner remaining in the toner container 32Y is detected based on a change of capacitance in the powder conveyance path. A detailed description of this configuration is given below.

Figure 5:
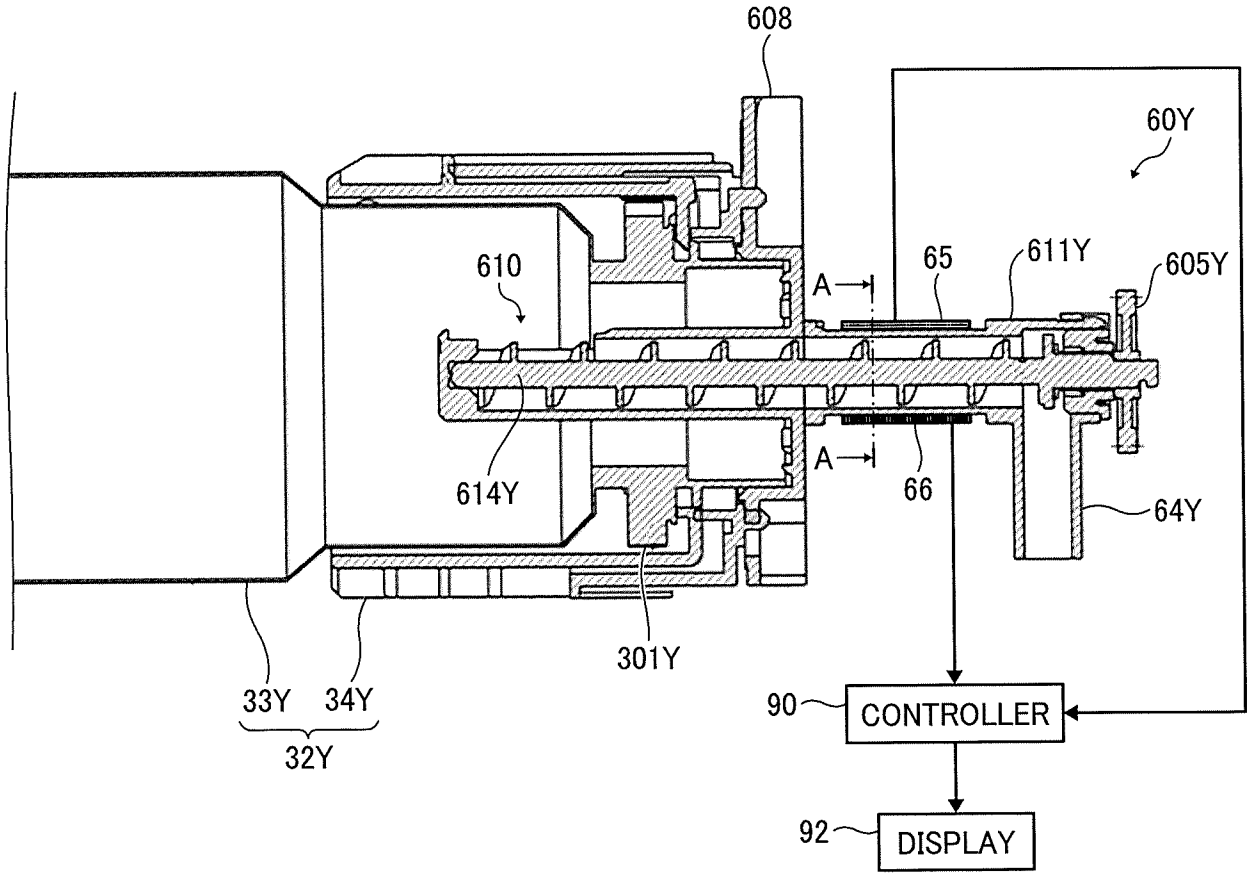
FIG. 5 is a cross-sectional view of a main part of the toner container and the toner supply device.
Figure 6:
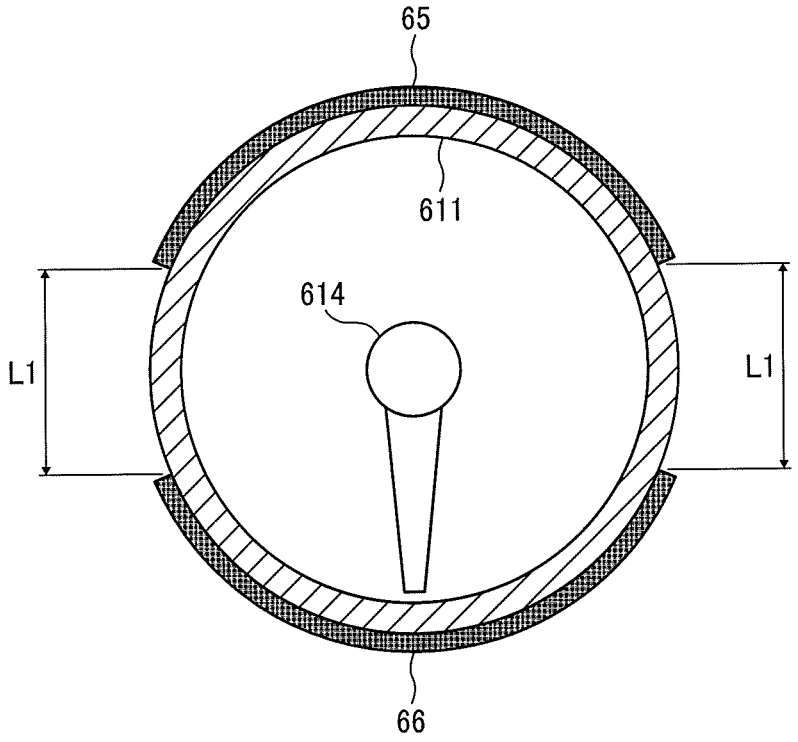
FIG. 6 is a cross-sectional view along the line A-A in FIG. 5.

FIG. 5 is a cross-sectional view of a main part of the toner container 32Y and the toner supply device 60Y, and FIG. 6 is a cross-sectional view along the line A-A in FIG. 5.

As illustrated in FIGS. 5 and 6, electrodes 65 and 66 are disposed outside the cylindrical conveyance nozzle 611Y. The electrodes 65 and 66 have an arc shape as viewed in the toner conveyance direction (see FIG. 6) and a certain length along the toner conveyance direction (see FIG. 5). The electrodes 65 and 66 can be made of any conductive material, for example, a thin conductive tape can be used. As illustrated in FIG. 6, the electrode 65 covers an upper portion of the conveyance nozzle 611Y, and the electrode 66 covers a lower portion of the conveyance nozzle 611Y. That is, the pair of electrodes 65 and 66 is disposed on opposite sides of the conveyance nozzle 611Y. As illustrated in FIG. 5, the electrodes 65 and 66 are connected to the controller 90.

The controller 90 applies a bias to the electrodes 65 and 66 to measure capacitance. A known method of measuring the capacitance can be used. In the present embodiment, a charging method is used in which the capacitance is measured by a relation between the time of charge arrival and the voltage or current while a constant voltage or a constant current is applied between the electrodes 65 and 66. The measured capacitance varies depending on a dielectric constant between the electrodes 65 and 66. Toner has a higher dielectric constant than air. Accordingly, the dielectric constant varies according to the amount of toner in the conveyance nozzle 611Y. Therefore, the capacitance varies according to the amount of toner in the conveyance nozzle 611Y. Thus, the amount of toner in the conveyance nozzle 611Y can be detected by measuring the capacitance.

The controller 90 notifies of the toner depletion (i.e., almost all toner in the toner container 32Y is depleted) when the capacitance between the two electrodes 65 and 66 is smaller than a predetermined value. Specifically, when the capacitance between the two electrodes 65 and 66 becomes smaller than the predetermined value, the controller 90 determines the toner depletion. When determining the toner depletion, the controller 90 causes a display 92 of the copier 500 to display a message to prompt replacement of the toner container 32Y.

Figure 7:
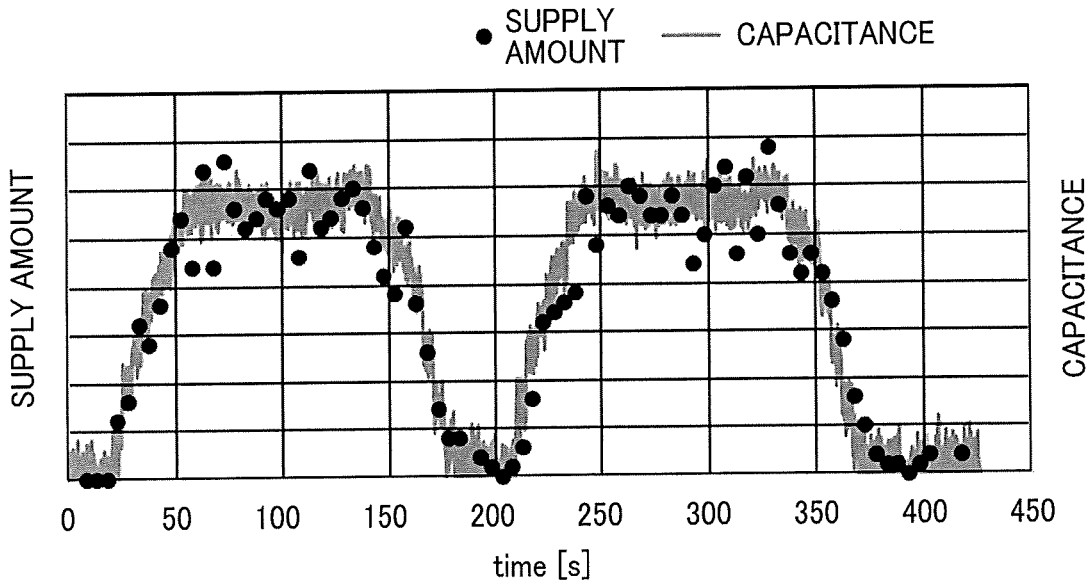
FIG. 7 is a graph illustrating a relation between capacitance and an amount of supplied toner.

FIG. 7 is a graph illustrating a relation between capacitance and an amount of supplied toner.

With the above-described toner supply device 60, the toner container 32 and the conveying screw 614 were repeatedly driven for 0.5 seconds (i.e., supply operation) and stopped for 4.5 seconds. The amount of supplied toner is defined by measuring an amount of toner that falls into the downward toner passage 64 for 0.5 seconds during the supply operation. The capacitance was measured by applying the bias to the electrodes 65 and 66. The measurement started from a state in which the conveyance nozzle 611 was empty, the toner container 32 was removed in the middle of measurement to make a pseudo toner depletion, and the toner container 32 was set again. After a predetermined elapsed time, the toner container 32 was removed again.

As illustrated in FIG. 7, it can be seen that the increase and decrease of the amount of supplied toner coincide with the increase and decrease of the capacitance because, as toner is supplied from the toner container 32 to the empty conveyance nozzle 611, the toner gradually fills the conveyance nozzle 611. Accordingly, the amount of toner that falls into the downward toner passage 64 increases, thereby increasing the amount of supplied toner. Simultaneously, as the toner gradually fills the conveyance nozzle 611, the dielectric constant gradually increases, thereby increasing the capacitance. The amount of toner supplied from the toner container 32 to the conveyance nozzle 611 is generally greater than the amount of toner transported by the conveying screw 614. Therefore, after the toner fills the conveyance nozzle 611, the state in which the conveyance nozzle 611 is filled with the toner is maintained, thereby stabilizing the amount of supplied toner to almost a constant value. As the state in which the conveyance nozzle 611 is filled with the toner is maintained, the capacitance becomes substantially constant.

As the toner container 32 is removed, toner is not supplied to the conveyance nozzle 611. As a result, the amount of toner in the conveyance nozzle 611 gradually decreases, thereby decreasing the amount of supplied toner. As the amount of toner in the conveyance nozzle 611 gradually decreases, the dielectric constant gradually decreases, thereby decreasing the capacitance. Therefore, the amount of supplied toner correlates with the amount of toner in the conveyance nozzle 611.

As illustrated in FIG. 7, in the pseudo toner depletion made by removing the toner container 32, the capacitance decreases. Therefore, if the capacitance falls below a threshold value, the controller 90 can determine the toner depletion. That is, the controller 90 can determine the toner depletion based on the change of the capacitance in the conveyance nozzle 611.

With such a configuration, in which the controller 90 determines the toner depletion based on the change of the capacitance in the conveyance nozzle 611, the following advantages can be attained as compared with a configuration in which a controller determines the toner depletion based on the change of the capacitance in a toner container. Differing from the toner container 32, the conveyance nozzle 611 is not frequently replaced and is generally secured to a certain position in the toner supply device 60. Therefore, a distance between the conveyance nozzle 611 and the electrodes 65 and 66 hardly changes. Thus, the correlation between the amount of toner and the capacitance in the conveyance nozzle 611 does not change, thereby maintaining the detection of toner depletion with high accuracy.

Further, the toner container 32 has a larger outer diameter than the conveyance nozzle 611. If a pair of electrodes covers upper and lower portions of the toner container 32, the electrodes increase in size, thereby increasing the device cost. In addition, a distance between the electrodes becomes long, thereby preventing capacitance detection with high sensitivity. On the other hand, the conveyance nozzle 611 has a smaller diameter than the toner container 32. Accordingly, even if the pair of electrodes 65 and 66 is disposed above and below the conveyance nozzle 611 as illustrated in FIG. 6, the electrodes 65 and 66 can decrease in size, thereby reducing the device cost as compared with the arrangement in which the pair of electrodes is disposed above and below the toner container 32.

In addition, a distance between the electrodes 65 and 66 can be shorter, enabling the capacitance to be detected with high sensitivity as compared with the arrangement in which the pair of electrodes is disposed above and below the toner container 32.

Further, as illustrated in FIG. 6, since the pair of electrodes 65 and 66 covers upper and lower portions of the conveyance nozzle 611, an entire interior of the conveyance nozzle 611 is included in lines of electric force between the pair of electrodes 65 and 66 (i.e., an electric field) in the cross section perpendicular to the toner conveyance direction of the conveyance nozzle 611, thereby accurately detecting a change of the amount of toner in the conveyance nozzle 611 based on the capacitance.

In the present embodiment, the pair of electrodes 65 and 66 is disposed outside the conveyance nozzle 611 to detect the toner depletion, thereby preventing the electrodes 65 and 66 from being contaminated by toner adhesion. As a result, the electrodes 65 and 66 do not need to be cleaned regularly, thereby maintaining satisfactory detection results. Further, differing from a piezoelectric sensor, the detection with the pair of electrodes 65 and 66 does not depend on flowability of toner. As a result, the toner depletion can be detected with high accuracy by the pair of electrodes 65 and 66 as compared with the piezoelectric sensor.

A length of the electrodes 65 and 66 in the toner conveyance direction of the conveyance nozzle 611 is preferably as long as possible. If the length of the electrodes 65 and 66 is long, the amount of toner in the wide range can be detected. As a result, the detection is hardly affected by the change of the amount of toner in the toner conveyance direction, thereby detecting the amount of toner with high accuracy. As illustrated in FIG. 6, a distance L1 between ends of the electrodes 65 and 66 is preferably as far as possible.

The conveying screw 614 in the conveyance nozzle 611 is made of insulative material. This is because, if the conveying screw 614 is made of conductive material, the capacitance may be varied by the influence of the conveying screw 614. The conveying screw 614 is made of insulative material, thereby detecting the toner depletion with high accuracy.

Figure 8:
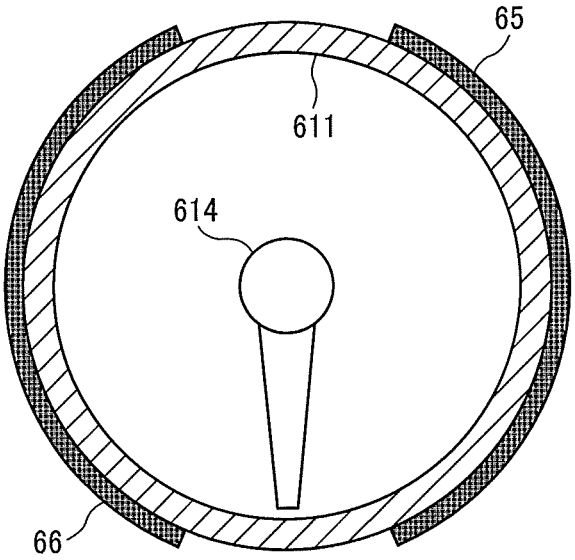
FIG. 8 is a cross-sectional view illustrating an example of an arrangement in which a pair of electrodes is provided so as to cover a conveyance nozzle in a lateral direction.
Figure 9:
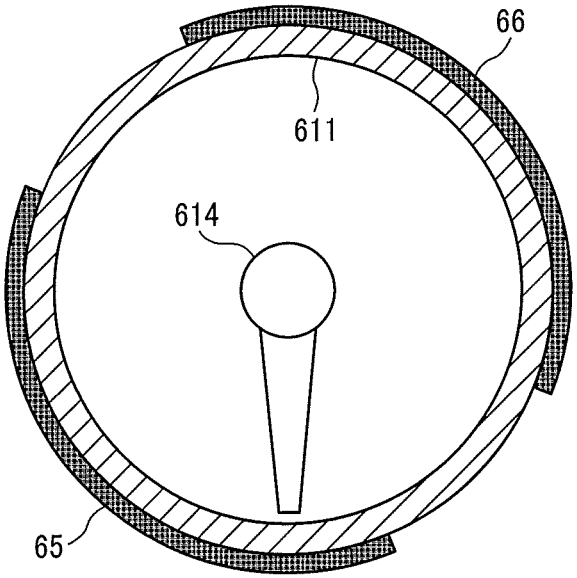
FIG. 9 is a cross-sectional view illustrating an example of an arrangement in which a pair of electrodes is provided so as to cover the conveyance nozzle diagonally.

In the present embodiment, the pair of electrodes 65 and 66 is disposed so as to cover the conveyance nozzle 611 in the vertical direction. Alternatively, the pair of electrodes 65 and 66 can be disposed so as to cover the conveyance nozzle 611 in the lateral direction as illustrated in FIG. 8. In yet another example, the pair of electrodes 65 and 66 can be disposed so as to cover the conveyance nozzle 611 diagonally as illustrated in FIG. 9.

Figure 10B:
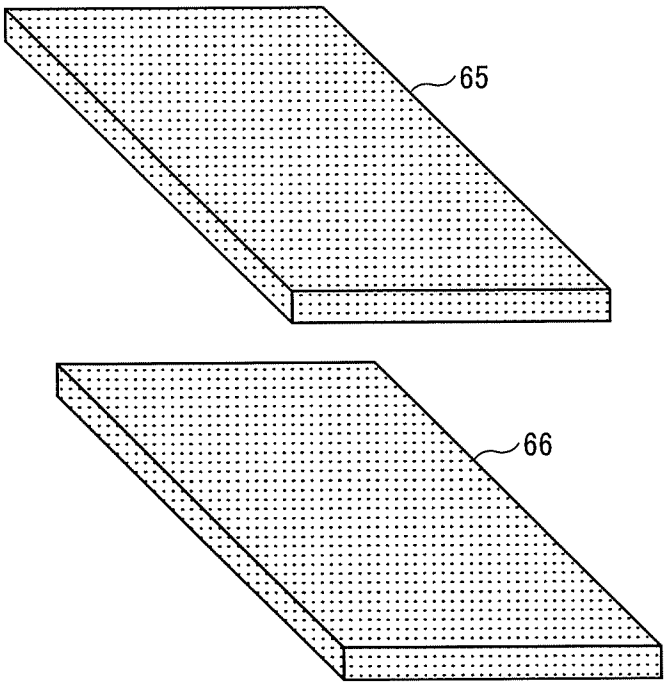
FIG. 10B is a perspective view of the parallel flat plates in FIG. 10A.
Figure 10A:
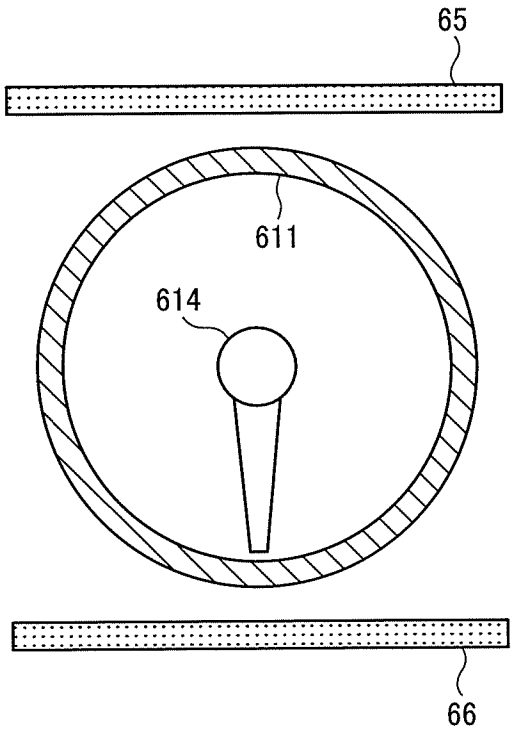
FIG. 10A is a cross-sectional view illustrating an example of an arrangement in which a pair of electrodes is parallel flat plates that sandwich the conveyance nozzle.

In the present embodiment, the pair of electrodes 65 and 66 has an arc-shaped configuration along an outer circumference of the conveyance nozzle 611. Alternatively, a pair of electrodes can include parallel flat plates as illustrated in FIGS. 10A and 10B. In the case of the arc-shape, as described later, a density of lines of electric force between the ends of the pair of electrodes 65 and 66 is higher than a density of lines of electric force in the other portions. As a result, if a distance between the end portions (i.e., the distance L1 in FIG. 6) deviates even slightly from the specified value due to assembly tolerances, the capacitance largely varies. Therefore, calibration is required for each device, and manufacturing cost may increase. Further, the capacitance when the toner is unevenly distributed in the conveyance nozzle 611 may be different from the capacitance when the toner is evenly distributed.

On the other hand, in the case of the parallel flat plates, since lines of electric force between the electrodes are uniform, the capacitance does not vary significantly even if some tolerances exist. As a result, the calibration is not required, thereby reducing manufacturing cost. With the parallel flat plates, the capacitance does not vary between when the toner is unevenly distributed in the conveyance nozzle 611 and when the toner is evenly distributed. Therefore, the toner depletion can be stably detected. On the other hand, as described later, the pair of arc-shaped electrodes 65 and 66 can increase detection sensitivity and has an advantage that the toner depletion can be detected accurately.

In the present embodiment, a radius of the arc shape of the pair of electrodes 65 and 66 is substantially the same as a radius of the outer circumference of the conveyance nozzle 611, and an inner circumference surface of the electrodes 65 and 66 is in close contact with the outer circumference of the conveyance nozzle 611. Alternatively, the arc-shaped electrodes 65 and 66 can be disposed with a predetermined clearance from the outer circumference of the conveyance nozzle 611. When the pair of electrodes 65 and 66 is in close contact with the outer circumference of the conveyance nozzle 611, if the conveyance nozzle thermally expands, the distance between the pair of electrodes 65 and 66 may vary, thereby varying the capacitance corresponding to the amount of toner. On the other hand, when the pair of electrodes 65 and 66 is disposed with a predetermined clearance from the outer circumference of the conveyance nozzle 611, the toner depletion can be stably detected because the distance between the pair of electrodes 65 and 66 does not change due to thermal expansion of the conveyance nozzle 611.

Note that, when the pair of electrodes 65 and 66 is in close contact with the outer circumference of the conveyance nozzle 611, the distance between the pair of electrodes 65 and 66 can be shorter, thereby increasing the detection sensitivity. Therefore, whether the pair of electrodes 65 and 66 is in close contact with the outer circumference of the conveyance nozzle 611 or is disposed with a predetermined clearance from the outer circumference of the conveyance nozzle 611 may be appropriately selected according to the configuration of the device.

Further, a part of the conveyance nozzle 611 may be the pair of electrodes 65 and 66.

Figure 11:
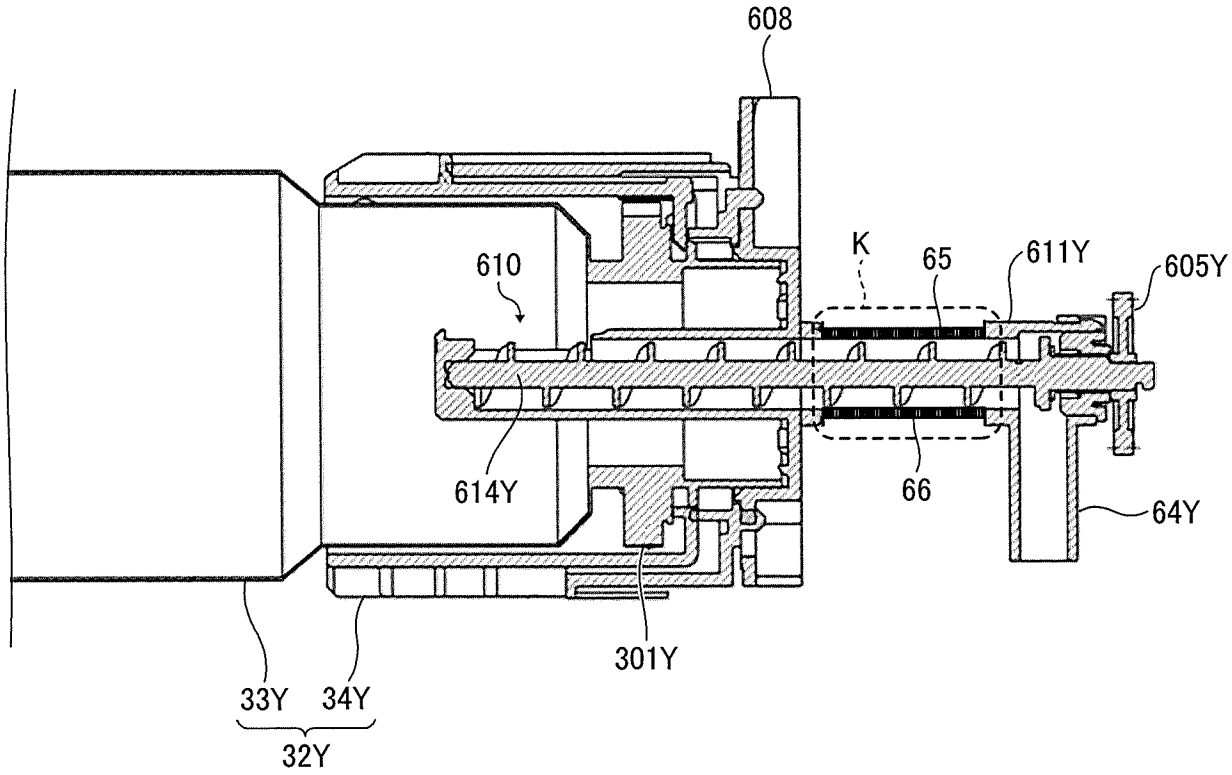
FIG. 11 is a cross-sectional view of the main part of the toner container and a toner supply device in which a part of a conveyance nozzle is a pair of electrodes.

FIG. 11 is a cross-sectional view of the main part of the toner container 32Y and the toner supply device 60Y in which a part of the conveyance nozzle 611 is the pair of electrodes 65 and 66. FIG. 12A is an enlarged schematic view of a portion of the conveyance nozzle 611Y enclosed by the broken line K illustrated in FIG. 11, and FIG. 12B is a cross-sectional view along the line B-B in FIG. 12A.

Figure 12B:
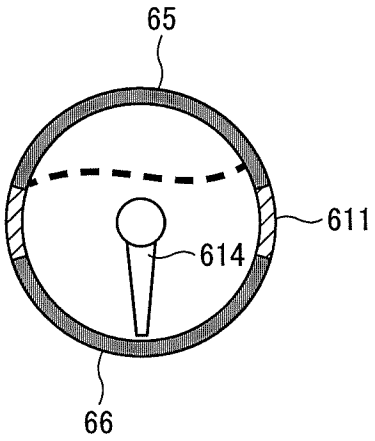
FIG. 12B is a cross-sectional view along the line B-B in FIG. 12A.
Figure 12A:
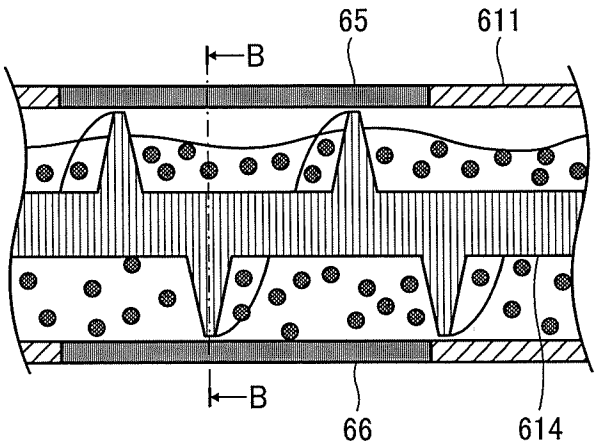
FIG. 12A is an enlarged schematic view of a portion of the conveyance nozzle enclosed by the broken line K illustrated in FIG. 11.

As illustrated in FIGS. 11, 12A, and 12B, the upper and lower portions of the conveyance nozzle 611Y made of resin are cut out, and the electrodes 65 and 66 are fitted into the cut-out portions. As a result, the pair of electrodes 65 and 66 constitutes a part of the outer wall of the conveyance nozzle 611.

With this configuration, the distance between the electrodes 65 and 66 can be shorter by the thickness of the conveyance nozzle 611 as compared with the arrangement in which the pair of electrodes 65 and 66 is in close contact with the outer circumference of the conveyance nozzle 611. Accordingly, the detection sensitivity can be increased (i.e., the change of capacitance relative to the change of the amount of toner can be increased).

Further, the conveyance nozzle 611 is made of resin and is likely to expand thermally. When the pair of electrodes 65 and 66 is in close contact with the outer circumference of the conveyance nozzle 611, the distance between the pair of electrodes 65 and 66 may vary, thereby varying the relation between the amount of toner and the capacitance due to temperature in the toner supply device 60. On the other hand, when the pair of electrodes 65 and 66 made of metal is the part of the conveyance nozzle 611, the thermal expansion of the conveyance nozzle 611 is minimized, thereby preventing the distance between the electrodes 65 and 66 from changing. This is because the metal has a small thermal expansion coefficient. As a result, variation of the relation between the amount of toner and the capacitance can be minimized.

Further, the conveyance nozzle 611 made of resin may be triboelectrically charged by the friction with toner, and the toner may adhere to an inner circumference surface of the conveyance nozzle 611. When such toner adhesion occurs at a point where the pair of electrodes 65 and 66 is in close contact with the outer circumference of the conveyance nozzle, the capacitance may not fall below the threshold, which may cause erroneous detection, although toner in the conveyance nozzle 611 actually becomes less than the specified amount, and the toner in the toner container 32 is depleted.

On the other hand, when the pair of electrodes 65 and 66 is the part of the conveyance nozzle 611, even if the toner in the conveyance nozzle rubs against the electrodes 65 and 66, the electrodes 65 and 66 are not triboelectrically charged. Therefore, in the area where the capacitance is detected between the pair of electrodes, adhesion of toner in the conveyance nozzle 611 to the inner circumferential surface of the conveyance nozzle 611 can be minimized. As a result, the erroneous detection of the toner depletion can be prevented.

Further, resin may absorb moisture depending on material of the resin, causing the capacitance of the resin to change. Therefore, when the pair of electrodes 65 and 66 is disposed on the outer circumference of the conveyance nozzle 611 made of resin, the relationship between the amount of toner and the capacitance may change due to the influence of the change of the capacitance of the conveyance nozzle 611. On the other hand, when the pair of electrodes 65 and 66 is the part of the conveyance nozzle 611, the change of the relationship between the amount of toner and the capacitance can be minimized, enabling to detect the toner depletion with high accuracy without the influence of the change of the capacitance of the conveyance nozzle 611.

Figure 13:
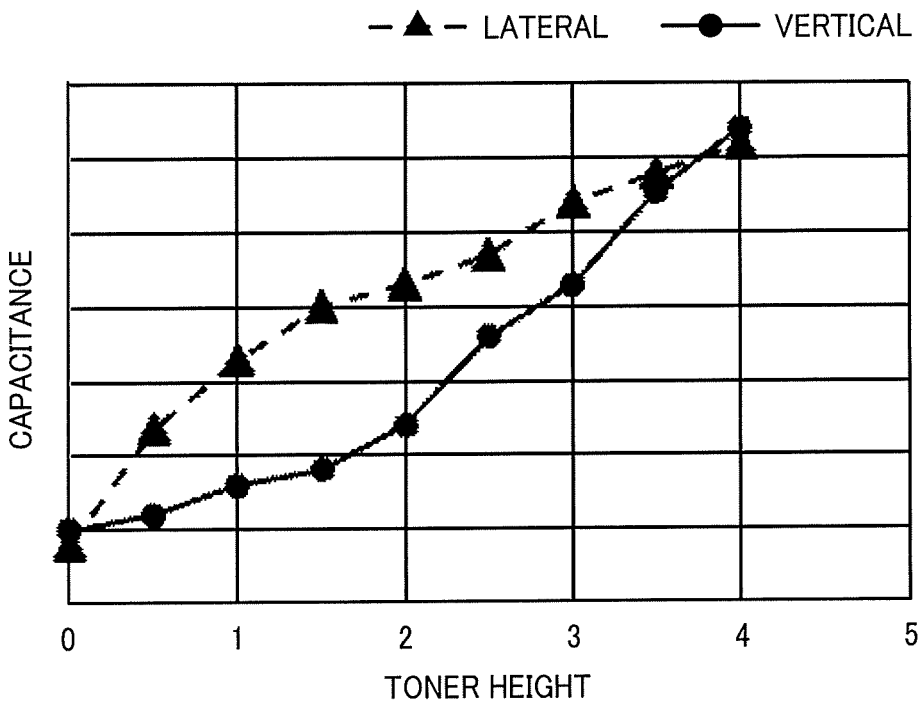
FIG. 13 is a graph illustrating a relation between capacitance and a toner height in the conveyance nozzle in a configuration in which a pair of electrodes is provided so as to cover the conveyance nozzle in a vertical direction and the lateral direction.
Figure 14:
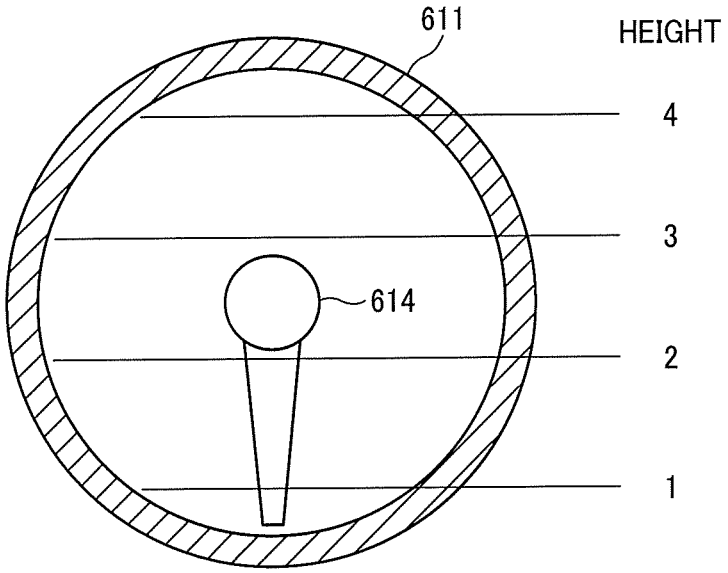
FIG. 14 is a schematic diagram to illustrate the toner height illustrated in FIG. 13.

FIG. 13 is a graph illustrating a relation between capacitance and a toner height in the conveyance nozzle 611 in a configuration in which the pair of electrodes 65 and 66 is provided so as to cover the conveyance nozzle 611 in the vertical direction and the lateral direction. FIG. 14 is a schematic diagram to illustrate the toner height illustrated in FIG. 13. In the present embodiment, when toner in the toner container 32 is sufficient, the toner height in the conveyance nozzle 611 is approximately 4.

Figure 15:
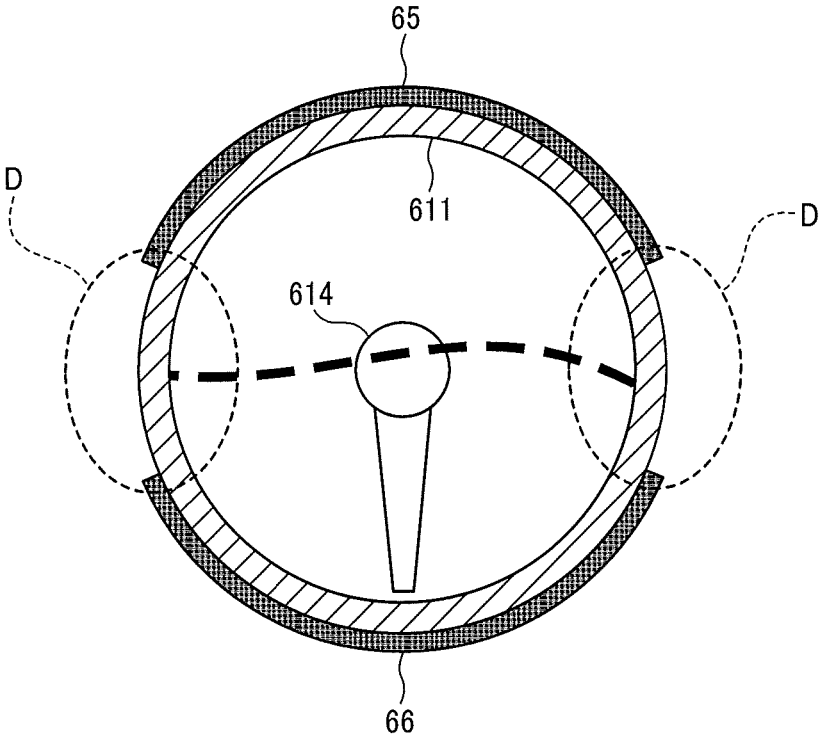
FIG. 15 is a cross-sectional view illustrating high sensitivity areas in a configuration in which the pair of electrodes is provided in the vertical direction.

As illustrated in FIG. 13, in a configuration in which the electrodes 65 and 66 are arranged in the vertical direction, a slope of the graph is large within the toner height of 2 to 3 (i.e., the change of capacitance relative to the toner height is large), and the detection sensitivity is high. On the other hand, in a configuration in which the electrodes 65 and 66 are arranged in the lateral direction, a slope of the graph is large within the toner height of 0 to 1, and the detection sensitivity is high. This is because, as illustrated in FIG. 15, lines of electric force are dense in areas D enclosed by the dashed circles that is vicinity of the ends of the electrodes 65 and 66 where the distance between the electrodes 65 and 66 is short, thereby increasing the detection sensitivity. Therefore, when the toner height varies in the areas D, the change of capacitance becomes greater. As a result, the slope of the graph is large within the toner height of 2 to 3.

The detection sensitivity is preferably high (i.e., the change of capacitance relative to the toner height is great) near the threshold value of capacitance to determine the toner depletion, thereby determining the toner depletion with high sensitivity. In the present embodiment, the toner depletion is preferably detected early after toner is depleted in the toner container 32. This is because, without the sub-hopper as in the present embodiment, the amount of toner supplied to the developing device 50 becomes almost zero in a short period of time after the toner in the toner container 32 is depleted. Accordingly, the toner depletion is preferably detected when a slight amount of toner remains in the toner container 32, the amount of toner supplied to the conveyance nozzle 611 decreases, and the amount of toner in the conveyance nozzle 611 starts to decrease. Therefore, in the present embodiment, the threshold value to determine the toner depletion is preferably the capacitance near the toner height of 2 to 3. Thus, the toner depletion can be determined with high sensitivity in a configuration in which the electrodes 65 and 66 are arranged in the vertical direction because the vertical arrangement of the electrodes 65 and 66 has better sensitivity than the lateral arrangement of the electrodes 65 and 66 near the toner height of 2 to 3. Therefore, in the case without the sub-hopper, the electrodes 65 and 66 are preferably arranged in the vertical direction as illustrated in FIG. 6.

Beside the above example, for example, in a case in which a sub-hopper is provided in the toner supply device 60, a certain amount of toner can be supplied to the developing device 50 for a certain period after the toner is depleted in the toner container 32. Accordingly, the toner depletion can be determined after toner is completely depleted in the toner container 32. When the toner depletion is detected after toner is completely depleted in the toner container 32, the lateral arrangement of the electrodes 65 and 66, which has high sensitivity near the toner height of 0 to 1, is preferable.

Figure 16:
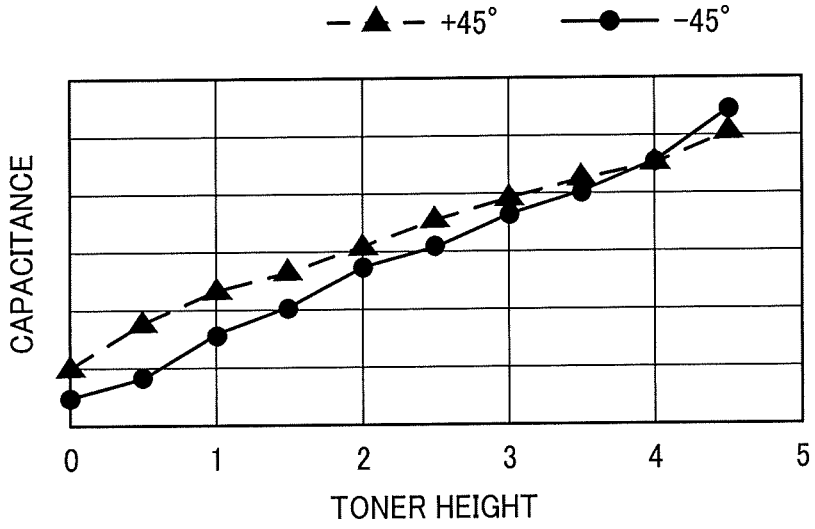
FIG. 16 is a graph illustrating a relation between capacitance and a toner height in a configuration in which the pair of electrodes is provided so as to cover the conveyance nozzle diagonally as illustrated in FIG. 9.

FIG. 16 is a graph illustrating the relation between the capacitance and the toner height in a configuration in which the pair of electrodes 65 and 66 is provided so as to cover the conveyance nozzle 611 diagonally as illustrated in FIG. 9.

The broken line in FIG. 16 indicates the relation between the capacitance and the toner height in a configuration in which the pair of electrodes 65 and 66 is inclined clockwise by an angle of 45° (+45°) relative to the vertical arrangement of the electrodes 65 and 66 in FIG. 6 (see FIG. 9). The solid line in FIG. 16 indicates the relation between the capacitance and the toner height in a configuration in which the pair of electrodes 65 and 66 is inclined counterclockwise by an angle of 45° (−45°) relative to the vertical arrangement of the electrodes 65 and 66 in FIG. 6.

As illustrated in FIG. 16, the change of capacitance relative to the toner height is approximately constant in both cases of inclination angles of +45° and −45° in the arrangement of the electrodes 65 and 66. Therefore, the toner depletion can be satisfactorily determined based on the capacitance in the both cases of inclination angles of +45° and −45°.

Figure 17B:
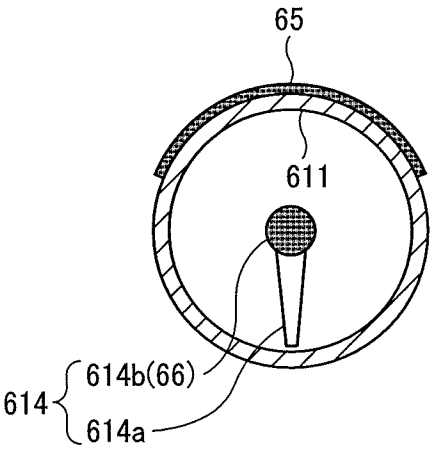
FIGS. 17A and 17B are cross-sectional views illustrating an example of an arrangement in which one of the pair of electrodes is a shaft of a conveying screw in the conveyance nozzle.
Figure 17A:
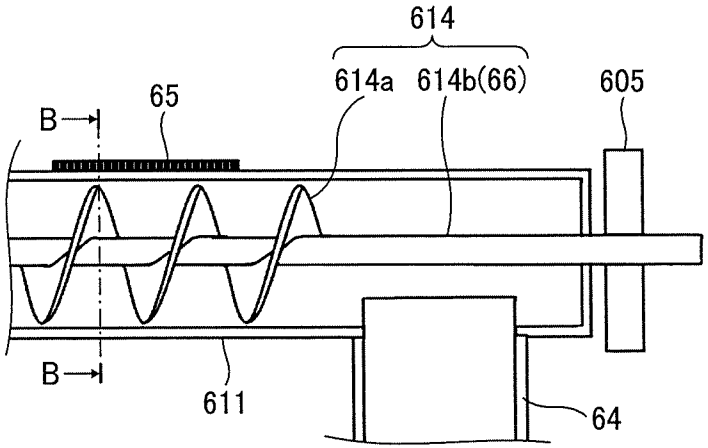

FIGS. 17A and 17B are cross-sectional views illustrating an arrangement example in which one electrode of the pair of electrodes 65 and 66 is a shaft 614*b* of the conveying screw 614. FIG. 17A is an enlarged cross-sectional view of the vicinity of the conveyance nozzle 611, and FIG. 17B is a cross-sectional view along the line B-B in FIG. 17A.

In an example in FIGS. 17A and 17B, the shaft 614*b* of the conveying screw 614 is made of conductive material, and a blade 614*a* of the conveying screw 614 is insulative material. An electric field is formed between the shaft 614*b* of the conveying screw 614 (i.e., the electrode 66) and the electrode 65, and the capacitance is measured therebetween.

With this configuration in FIGS. 17A and 17B, the distance between the electrodes 65 and 66 (i.e., the distance between the shaft 614*b* of the conveying screw 614 and the electrode 65) can be shorter as compared with the arrangement in which the pair of electrodes 65 and 66 is disposed on opposite sides of the conveyance nozzle 611. Accordingly, the detection sensitivity can be increased (i.e., the change of capacitance relative to the change of the amount of toner can be increased). As a result, the toner depletion can be detected with high accuracy. Further, the existing member (i.e., the shaft 614*b*) can be used as the electrode 66, thereby reducing the device cost.

Figure 18:
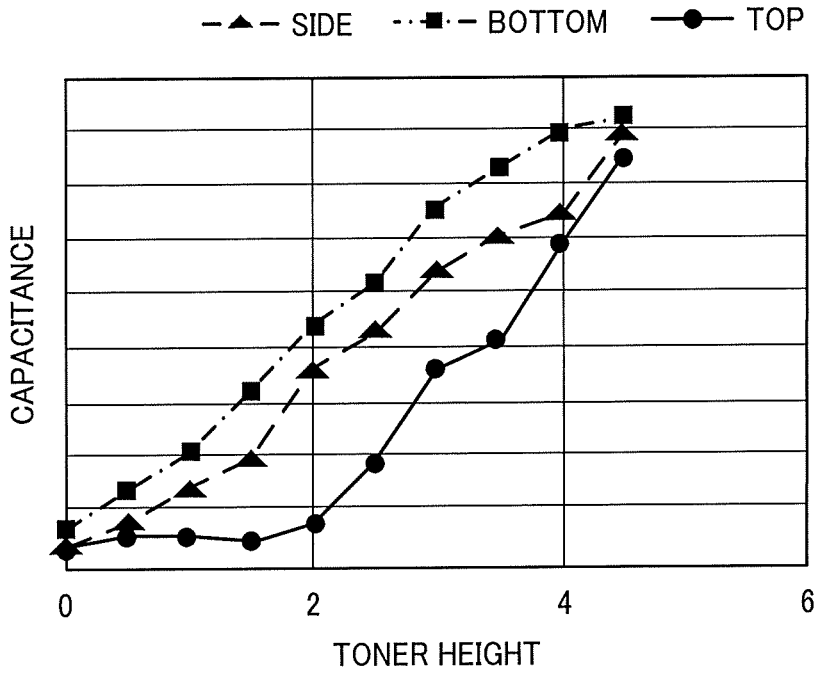
FIG. 18 is a graph illustrating a relation between capacitance and a toner height in the conveyance nozzle in a configuration in which the shaft of the conveying screw is the electrode.
Figure 19A:
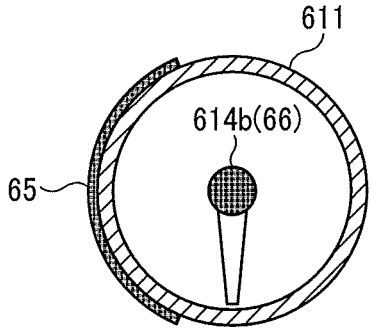
FIG. 19A is a cross-sectional view illustrating an example of an arrangement in which an external electrode is disposed on the side of the conveyance nozzle.
Figure 19B:
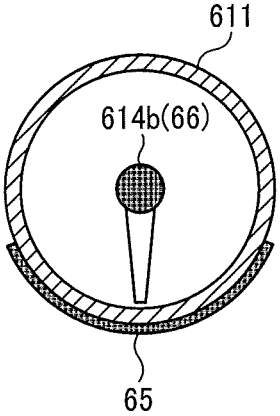
FIG. 19B is a cross-sectional view illustrating an example of an arrangement in which the external electrode is disposed at a bottom portion of the conveyance nozzle.

FIG. 18 is a graph illustrating the relation between the capacitance and the toner height in a configuration in which the shaft 614*b* of the conveying screw 614 is the electrode. The graph with the triangle marks in FIG. 18 is indicates the relation between the capacitance and the toner height in a configuration in which the external electrode 65 is disposed on the side of the conveyance nozzle 611 as illustrated in FIG. 19A. The graph with the square marks in FIG. 18 is indicates the relation between the capacitance and the toner height in a configuration in which the external electrode 65 is disposed at the bottom portion of the conveyance nozzle 611 as illustrated in FIG. 19B. The graph with the circle marks in FIG. 18 is indicates the relation between the capacitance and the toner height in a configuration in which the external electrode 65 is disposed at the top portion of the conveyance nozzle 611 as illustrated in FIG. 19C.

Figure 19C:
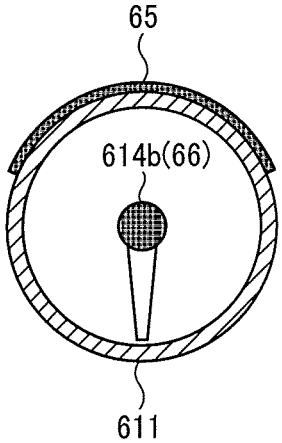
FIG. 19C is a cross-sectional view illustrating an example of an arrangement in which the external electrode is disposed at a top portion of the conveyance nozzle.

As illustrated in FIG. 18, the configuration in FIG. 19C, in which the external electrode 65 is disposed at the top portion of the conveyance nozzle 611, has high sensitivity when the toner height is high. Accordingly, in the case in which the toner depletion is detected when a slight amount toner remains in the toner container 32, and the amount of toner supplied to the conveyance nozzle 611 starts to decrease, the configuration in FIG. 19C is adopted, thereby detecting the toner depletion with high sensitivity.

As illustrated in FIG. 18, the configuration in FIG. 19B, in which the external electrode 65 is disposed at the bottom portion of the conveyance nozzle 611, has high sensitivity when the toner height is low. Accordingly, in the case in which the toner depletion is detected when toner is almost depleted in the toner container 32, and the amount of toner supplied to the conveyance nozzle 611 is almost zero, the configuration in FIG. 19B is adopted, thereby detecting the toner depletion with high sensitivity.

Figure 20:
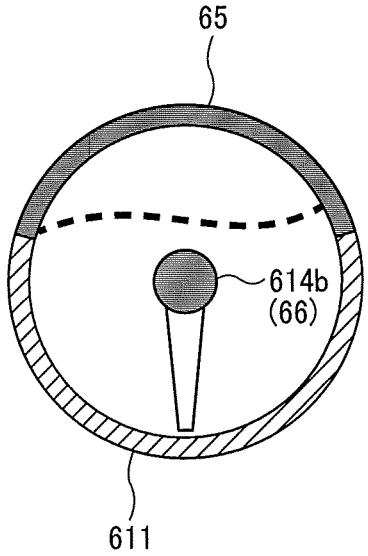
FIG. 20 is a cross-sectional view illustrating an example of an arrangement in which the external electrode is a part of the conveyance nozzle.

Further, as illustrated in FIG. 20, since the electrode 65 constitutes a part of the conveyance nozzle 611, the distance between the electrodes 65 and 66 can be shorter than the above-described embodiment in FIGS. 17A and 17B.

As described above, according to the present disclosure, an amount of powder remaining in a powder container can be accurately detected. The embodiments described above are examples and can provide, for example, the following effects, respectively.

Aspect 1

A powder supply device such as the toner supply device 60 includes a powder conveyance path such as the conveyance nozzle 611 and a pair of electrodes such as the pair of electrodes 65 and 66. The powder conveyance path is configured to transport powder from a powder container such as the toner container 32. The pair of electrodes are disposed at least in part in or on the powder conveyance path. The powder supply device is configured to detect an amount of powder in the powder conveyance path based on change of capacitance between the pair of electrodes.

In a comparative example, a pair of electrodes is disposed outside and below the powder container and arranged in parallel with a predetermined space from the powder container. The amount of powder remaining in the powder container is detected based on the change of capacitance between the pair of electrodes. In this case, the amount of powder is not detected with high accuracy due to the following reasons. The powder container such as a toner bottle is installable in and removable from an apparatus body. When the powder container becomes empty, the empty powder container is replaced with a full powder container. Due to shape error or the like, the distance between the powder container and the pair of electrodes varies each time the powder container is replaced. As a result, even if the amount of powder in the powder container is the same, the capacitance between the electrodes varies according to the powder container to be set. Therefore, the amount of powder in the powder container may not be detected with high accuracy.

On the other hand, in Aspect 1, the amount of powder in the powder conveyance path is detected based on change of capacitance between the pair of electrodes. As the amount of powder in the powder container is small, the amount of powder supplied from the powder container to the powder conveyance path becomes small, thereby decreasing the amount of toner in the powder conveyance path. Therefore, the powder supply device can detect that the amount of powder in the powder container is small based on the capacitance in the powder conveyance path. Further, the powder conveyance path is maintained to be secured to a certain position in the apparatus body and is not replaced. Therefore, the distance between the powder conveyance path and the pair of electrodes hardly varies, and the capacitance corresponding to the same amount of powder in the powder conveyance path is unlikely to vary. As a result, the amount of powder in the powder conveyance path can be detected accurately.

Aspect 2

In Aspect 1, the pair of electrodes such as the pair of electrodes 65 and 66 is disposed on opposite sides of the powder conveyance path such as the conveyance nozzle 611.

Accordingly, as described in the above embodiments, the change of capacitance in the entire powder conveyance path can be measured in the cross section perpendicular to the powder conveyance direction in the powder conveyance path such as the conveyance nozzle 611, thereby satisfactorily detecting the change of the amount of powder in the powder conveyance path. As a result, the toner depletion can be satisfactorily detected. In addition, the electrode is prevented from being contaminated by toner as compared with the case in which electrodes are disposed in the powder conveyance path.

Aspect 3

In Aspect 2, the powder conveyance path such as the conveyance nozzle 611 is configured to transport the powder such as toner horizontally, and the pair of electrodes is disposed on opposite sides of the powder container in a vertical direction.

Accordingly, as described in the above embodiment, the powder supply device can detect that the amount of toner in the powder conveyance path such as the conveyance nozzle 611 starts to decrease with high sensitivity.

Aspect 4

In Aspect 3, the powder conveyance path such as the conveyance nozzle 611 is cylindrical, and the pair of electrodes has an arc-shaped configuration.

Accordingly, as described in the above embodiments, the distance between ends of electrodes can be shortened, thereby increasing the detection sensitivity.

Aspect 5

In Aspect 1, a part of the powder conveyance path such as the conveyance nozzle 611 is the pair of electrodes such as the pair of electrodes 65 and 66.

Accordingly, as described in the above embodiments, the distance between the electrodes can be shortened as compared with the arrangement in which the pair of electrodes is disposed outside the powder conveyance path such as the conveyance nozzle 611, enabling to increase the detection sensitivity. Further, in the area where the capacitance is detected, adhesion of powder such as toner to the inner circumferential surface of the powder conveyance path can be minimized, and the amount of remaining powder can be detected with high accuracy. Furthermore, the decrease of detection accuracy due to change of the capacitance of the powder conveyance path can be minimized.

Aspect 6

In Aspect 2, the pair of electrodes includes flat plates.

Accordingly, as described in the above embodiments, lines of electric force between the electrodes can be uniformed, thereby preventing the capacitance from substantially varying even with certain tolerances. As a result, the calibration is not required, thereby reducing manufacturing cost.

Aspect 7

In Aspect 6, the pair of electrodes is arranged in parallel.

Accordingly, as described in the above embodiment, since the lines of electric force between the electrodes 65 and 66 can be uniform, the capacitance does not vary between when powder such as toner is unevenly distributed and when evenly distributed in the powder conveyance path such as the conveyance nozzle 611, enabling to stably detect the amount of powder.

Aspect 8

In any one of Aspects 2 through 7, a conveying screw such as the conveying screw 614 is disposed in the powder conveyance path such as the conveyance nozzle 611 and configured to transport the powder. The conveying screw is insulative material.

With this configuration, as described in the above embodiments, the conveying screw does not affect the capacitance.

Aspect 9

In Aspect 1, one of the pair of electrodes is an internal electrode disposed in the powder conveyance path, and the other of the pair of electrodes is an external electrode disposed outside the powder conveyance path.

Accordingly, as described in the above embodiments, the distance between the electrodes can be shortened as compared with the arrangement in which the pair of electrodes is disposed on opposite sides of the powder conveyance path, enabling to increase the detection sensitivity.

Aspect 10

In Aspect 9, a conveying screw such as the conveying screw 614 is disposed in the powder conveyance path such as the conveyance nozzle 611 and configured to transport the powder such as toner. The internal electrode is a shaft 614*b* of the conveying screw 614.

Accordingly, the existing member (i.e., the shaft 614*b*) can be used as the electrode, thereby reducing the device cost.

Aspect 11

In Aspect 10, a blade 614*a* of the conveying screw 614 is insulative material.

Accordingly, the blade 614*a* of the conveying screw 614 does not affect the capacitance.

Aspect 12

In any one of Aspects 1 through 11, the powder container such as the toner container 32 is cylindrical and configured to rotate.

Accordingly, as described in the above embodiments, the amount of powder remaining in the powder container can be accurately detected without being affected by eccentricity of the rotation of the powder container such as the toner container 32.

Aspect 13

An image forming apparatus includes an image bearer such as the photoconductor 41 configured to bear a latent image, a developing device such as the developing device 50 configured to develop the latent image on the image bearer with a developer, the powder container such as the toner container 32 configured to contain the developer used in the developing device, the powder supply device such as the toner supply device 60 according to any one of Aspects 1 through 12 configured to supply the developer in the powder container to the developing device.

Accordingly, an amount of developer remaining in the powder container can be satisfactorily detected.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A powder supply device configured to supply powder from a powder container, the powder supply device comprising:

a powder conveyance path configured to transport the powder in the powder container;

a conveying member disposed in the powder conveyance path and configured to transport the powder; and a pair of electrodes disposed at least in part in or on the powder conveyance path, wherein the powder supply device is configured to detect an amount of powder in the powder conveyance path based on change of capacitance between the pair of electrodes, and wherein the pair of electrodes is disposed on opposite sides of the powder conveyance path.

2. The powder supply device according to claim 1, wherein the powder conveyance path is cylindrical, and wherein the pair of electrodes has an arc-shaped configuration.

3. The powder supply device according to claim 1, wherein the pair of electrodes comprises flat plates.

4. The powder supply device according to claim 3, wherein the pair of electrodes is arranged in parallel.

5. The powder supply device according to claim 1, wherein the conveying member is made of an insulative material.

6. The powder supply device according to claim 1, wherein a part of the powder conveyance path is the pair of electrodes.

7. The powder supply device according to claim 1, wherein one of the pair of electrodes is an internal electrode disposed in the powder conveyance path, and other of the pair of electrodes is an external electrode disposed outside the powder conveyance path.

8. The powder supply device according to claim 7, wherein the conveying member includes a shaft and a blade, disposed in the powder conveyance path and configured to transport the powder, wherein the internal electrode is the shaft of the conveying member.

9. The powder supply device according to claim 8, wherein the blade of the conveying member is made of an insulative material.

10. The powder supply device according to claim 1, wherein the powder container is cylindrical and configured to rotate.

11. An image forming apparatus comprising:

an image bearer configured to bear a latent image;

a developing device configured to develop the latent image on the image bearer with a developer;

the powder container configured to contain the developer; and the powder supply device according to claim 1, configured to supply the developer contained in the powder container to the developing device.

12. A powder supply device configured to supply powder from a powder container, the powder supply device comprising:

a cylindrical powder conveyance path configured to transport the powder in the powder container; and a pair of electrodes disposed along the powder conveyance path, wherein the powder supply device is configured to detect an amount of powder in the powder conveyance path based on change of capacitance between the pair of electrodes, and wherein the pair of electrodes has an arc-shaped configuration.

13. The powder supply device according to claim 12, wherein the pair of electrodes is disposed on opposite sides of the powder conveyance path.

14. The powder supply device according to claim 12, wherein the pair of electrodes is arranged in parallel.

15. The powder supply device according to claim 12, further comprising a conveying screw disposed in the powder conveyance path and configured to transport the powder, wherein the conveying screw is made of an insulative material.

16. The powder supply device according to claim 12, wherein a part of the powder conveyance path is the pair of electrodes.

17. A powder supply device configured to supply powder from a powder container, the powder supply device comprising:

a powder conveyance path configured to transport the powder in the powder container;

a conveying screw including a shaft and a blade, disposed in the powder conveyance path and configured to transport the powder; and a pair of electrodes disposed along the powder conveyance path, wherein the powder supply device is configured to detect an amount of powder in the powder conveyance path based on change of capacitance between the pair of electrodes, wherein one of the pair of electrodes is an internal electrode disposed in the powder conveyance path, and other of the pair of electrodes is an external electrode disposed outside the powder conveyance path, and wherein the internal electrode is the shaft of the conveying screw.

18. The powder supply device according to claim 17, wherein the blade of the conveying screw is made of an insulative material.

* * * * *